United States Patent [19]

Keating

[11] Patent Number: 4,828,249

[45] Date of Patent: May 9, 1989

[54] POCKET SIZED EXERCISING APPLIANCE

[76] Inventor: Michael D. Keating, 6231 Sixth St. North, Oakdale, Minn. 55119

[21] Appl. No.: 920,368

[22] Filed: Oct. 20, 1986

[51] Int. Cl.[4] ..... A63B 11/08; A63B 21/02

[52] U.S. Cl. ..... 272/68; 272/141; 272/142

[58] Field of Search ..... 272/67, 68, 93, 75, 272/142, 135, 141, 143, 137; 128/26; 273/425; D21/198

[56] References Cited

U.S. PATENT DOCUMENTS

| | | | |
|---|---|---|---|
| 3,265,389 | 8/1966 | Carlson | 272/68 |
| 3,612,521 | 10/1971 | Wendeborn | 272/67 |
| 4,153,248 | 5/1979 | Holmes et al. | 272/68 |
| 4,515,364 | 5/1985 | Rotella | 272/135 |

FOREIGN PATENT DOCUMENTS

| | | | |
|---|---|---|---|
| 346136 | 9/1904 | France | 272/67 |
| 8403446 | 9/1984 | PCT Int'l Appl. | 272/93 |

OTHER PUBLICATIONS

Foamcraft Specialties, Inc., East Patterson, N.J., "Go Go Disc", Received Mar. 10, 1966.

*Primary Examiner*—Richard J. Apley
*Assistant Examiner*—S. R. Crow
*Attorney, Agent, or Firm*—John C. Barnes

[57] ABSTRACT

An exercising device which fits in a hand for exercising the hand, wrist and arm muscles comprises an elastomeric polygonal body member having a plurality of holes such that it can be squeezed and compressed in the hand or stretched with the thumb and fingers in the holes.

5 Claims, 1 Drawing Sheet

POCKET SIZED EXERCISING APPLIANCE

BACKGROUND OF THE INVENTION

The present invention relates to a small appliance for use in exercising, and in one aspect, to a pocket sized device for exercising the hand, wrist, arm, and upper body.

DESCRIPTION OF THE PRIOR ART

The prior art includes balls, hand grippers and rubber hand grip shaped objects to be squeezed to exercise the hand, wrist and arm.

The prior art devices are usable to strengthen the grip. The devices, however, are limited to strengthening the muscles working in a manner to close the hand. They are not effective to exercise the muscles in the reverse or hand opening movements. Further, the effectiveness of the devices is limited to the single exercise, i.e., closing the hand to strengthen the grip.

SUMMARY OF THE PRESENT INVENTION

The exercise device of the present invention is of a shape and size to be easily placed in one hand when in use or in the pocket when not in use. It is formed of a resilient elastic material. It has a multi-sided shape in plan view and preferrably has five sides, a front and rear face and a plurality of symmetrically positioned holes for receiving the fingers therethrough.

The durometer of the resilient elastic material can vary from 20 to 60 Shore hardness to vary the force necessary to crush the side walls and walls of the openings to compress the device and reduce the size of the faces. The user may also insert the ends of the fingers into the five openings with one finger in each opening. It is then effective to attempt to spread the fingers apart to expose the palm.

DESCRIPTION OF THE DRAWING

The invention will be further described with reference to the accompanying drawing wherein.

DETAILED DESCRIPTION OF THE INVENTION

Figure 1:
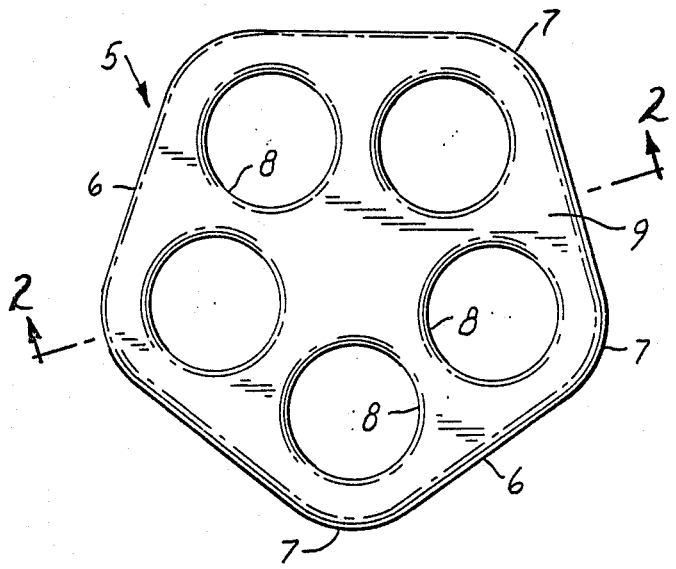
FIG. 1 is a plan view of the exercise device of the present invention, and the bottom view is substantially identical.
Figure 2:
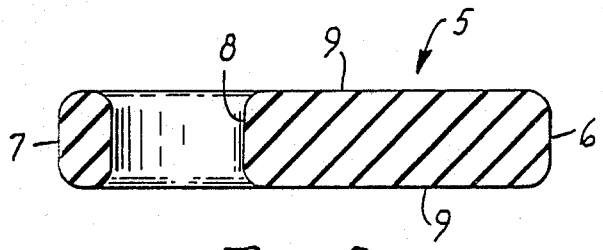
FIG. 2 is a cross sectional view of the device of FIG. 1 taken along the line 2—2 of FIG. 1.

The exercise device of the present invention, generally designated 5, comprises a pentagonal shaped body member of substantially equal sides 6 joined by arcuate sections 7. The sides 6 are curved or beveled to be convex. The sides join two opposite flat faces 9 and afford spatial separation of the user's fingers and the thumb when the body member is placed in the palm of the user's hand.

Within the pentagonal perimeter are five openings 8 which are generally symmetrically positioned to place one opening 8 adjacent each arcuate section 7. The openings extend beteween the faces 9. The device 5 is formed of a unitary molded resilient elastomer such as natural rubber. An example of a suitable material is Compound No. RD-2270 from Colonial Rubber Works, Inc. of Ravena, Ohio. The material should be available in different durometers affording a member of material which can be easily stretched or compressed, a second member of greater durometer affording more strength to distort the member, and even a harder material to require even greater strength and exertion to flex the member. The material can thus vary in durometer from 20 to 80 Shore hardness. A preferred series would be 20, 40 and 60 hardness values. In these hardness ranges, the devices would be of different pigmented or colored material to designated the elasticity.

In use, the device 5 may be placed in the palm of the hand and closing the hand will bring the fingers against the sides, causing them to flex and crush the walls to close the openings 8. This exercise exercises the flexors, i.e., carpi ulnaris, palmaris congus, carpi radialis, digitorum superficialis, and digitorum profundus. Alternatively, the finger tips and thumb may be placed in the five holes and then the fingers are moved to spread them apart. This exercise differs from that of the prior art devices and exercises the extensors, i.e., extensor carpi ulnaris, digiti minimi, digitorum, indicis, extensor carpi radialis, longus and brevis, and the thumb pollicis longus, pollicis brevis, abductor pollicis longus, and flexors pollicis longus.

Further, a finger or a pair of fingers from each hand can be placed in the holes 8. By separating the hands the back, shoulder, arms and fingers are strengthened. This same exercise with the device 5 positioned behind the neck and behind the back tension and exercise still other muscles.

The device 5 is generally the shape of a pentagon to fit in the palm of the hand with a peripheral dimension from an arcuate section or corner 7 to the opposite side 5 of between 3 and 3.5 inches and it has a thickness of 0.25 to 0.65 inch and smooth rounded side walls. The five holes 8 through the device 5 have a diameter of 0.625 to 0.75 inch.

Having thus described the invention with reference to a preferred embodiment, it will be appreciated that changes may be made without departing from the spirit or scope of the present invention.

I claim:

1. A pocket-sized exercise device principally for the hand, wrist and arm muscles comprising a unitary elastomeric polygon body member which will fit in a hand, said body member having opposite flat faces joined by five sides for spatially separating the fingers and thumb of a said hand whereby compressive force may be applied against said sides and having at least four generally circular spaced openings extending between said flat faces for receiving the fingers of the user to afford stretching of said body member by inserting the fingers of a said hand into said openings and forcing said fingers in a direction to separate the same.

2. An exercise device according to claim 1 having a durometer of between 20 and 80 Shore hardness.

3. An exercise device according to claim 1 having five openings between said flat faces.

4. An exercise device according to claim 3 wherein said device has a size sufficient to fit in the palm of the hand and has a thickness of between 0.25 and 0.65 inch.

5. An exercise device according to claim 3 wherein said device has a diagonal measure between a corner and the opposite side of between 3 and 3.5 inches and a thickness of 0.25 and 0.65 inch and a durometer of between 20 and 80 Shore hardness.

* * * * *